US009611440B2

(12) United States Patent
Meyer et al.

(10) Patent No.: US 9,611,440 B2
(45) Date of Patent: Apr. 4, 2017

(54) PROCESS FOR PRODUCING DRY SYNTHETIC NATURAL GAS (SNG)

(71) Applicant: L'AIR LIQUIDE, SOCIÉTÉ ANONYME POUR L'ETUDE ET L'EXPLOITATION DES PROCÉDÉS GEORGES CLAUDE, Paris (FR)

(72) Inventors: Manfred Meyer, Friedrichsdorf (DE); Stefan Walter, Griesheim (DE); Ute Herrlett, Rodgau (DE)

(73) Assignee: L'AIR LIQUIDE, SOCIÉTÉ ANONYME POUR L'ETUDE ET L'EXPLOITATION DES PROCÉDÉS GEORGES CLAUDE, Paris (FR)

( * ) Notice: Subject to any disclaimer, the term of this patent is extended or adjusted under 35 U.S.C. 154(b) by 0 days.

(21) Appl. No.: 14/424,462

(22) PCT Filed: Oct. 25, 2013

(86) PCT No.: PCT/EP2013/072433
§ 371 (c)(1),
(2) Date: Feb. 27, 2015

(87) PCT Pub. No.: WO2014/067877
PCT Pub. Date: May 8, 2014

(65) Prior Publication Data

US 2015/0299597 A1 Oct. 22, 2015

(30) Foreign Application Priority Data

Nov. 2, 2012 (DE) ..... 10 2012 110 520

(51) Int. Cl.

| | |
|---|---|
| ***C01B 3/36*** | (2006.01) |
| ***C10L 3/10*** | (2006.01) |
| ***C10J 3/00*** | (2006.01) |
| ***C10K 1/00*** | (2006.01) |
| ***C10K 3/04*** | (2006.01) |
| ***C10J 3/16*** | (2006.01) |
| ***C10L 3/08*** | (2006.01) |

(52) U.S. Cl.
CPC ..... *C10L 3/106* (2013.01); *C10J 3/00* (2013.01); *C10J 3/16* (2013.01); *C10K 1/004* (2013.01); *C10K 3/04* (2013.01); *C10L 3/08* (2013.01); *C10J 2300/1662* (2013.01); *C10L 2290/04* (2013.01); *C10L 2290/08* (2013.01); *C10L 2290/42* (2013.01); *C10L 2290/544* (2013.01)

(58) Field of Classification Search
CPC B01D 53/265; B01D 2252/2021; C10G 5/04; C10J 2300/1662; C10L 3/08
See application file for complete search history.

(56) References Cited

U.S. PATENT DOCUMENTS

| | | | | |
|---|---|---|---|---|
| 4,031,030 | A | 6/1977 | Rudolph | |
| 4,979,966 | A | 12/1990 | Rojey et al. | |
| 5,392,594 | A * | 2/1995 | Moore | C07C 27/06 423/242.4 |
| 5,670,027 | A | 9/1997 | Paradowski | |
| 2010/0163803 | A1* | 7/2010 | Klein | C01B 3/12 252/373 |
| 2012/0214881 | A1* | 8/2012 | Wahlstrom | B01D 53/1406 518/703 |
| 2012/0297822 | A1* | 11/2012 | Bailey | C01B 3/506 62/617 |

FOREIGN PATENT DOCUMENTS

| | | |
|---|---|---|
| DE | 2 542 055 | 3/1977 |
| WO | 2011 154535 A1 | 12/2011 |

OTHER PUBLICATIONS

Ullmann's Encyclopedia of Industrial Chemistry, 6th Ed., vol. 16, Gas Production, 2012, 483-539.

* cited by examiner

*Primary Examiner* — Imran Akram
(74) *Attorney, Agent, or Firm* — Norris McLaughlin & Marcus, P.A.

(57) ABSTRACT

A process for producing dry synthetic natural gas (SNG, Synthetic Natural Gas) from solid or liquid, carbonaceous fuel, substantially consisting of the following process steps:

a) gasification of a solid or liquid, carbonaceous fuel to a raw synthesis gas
b) cooling of the gas, separation of solids and the gas condensate
c) raw gas conversion
d) washing of the gas with methanol for separating hydrogen sulfide, carbon dioxide and moisture, wherein the methanol is circulated via a regeneration plant,
e) methanation,
f) condensation of moisture by means of cooling and/or cold water,
g) further drying of the gas by condensation at low temperature by adding methanol to avoid the formation of ice.

2 Claims, No Drawings

PROCESS FOR PRODUCING DRY SYNTHETIC NATURAL GAS (SNG)

This application is a 371 of International Patent Application No. PCT/EP2013/072433, filed Oct. 25, 2013, which claims foreign priority benefit under 35 U.S.C. §119 of German Patent Application No. 10 2012 110 520.0, filed Nov. 2, 2012, the disclosures of which patent applications are incorporated herein by reference.

FIELD OF THE INVENTION

This invention relates to a process for producing dry synthetic natural gas (SNG, Synthetic Natural Gas) from solid or liquid, carbonaceous fuel.

PRIOR ART

Such processes are known. In essence, they consist of the following process steps:

a) gasification of a solid or liquid, carbonaceous fuel to a raw synthesis gas
b) cooling of the gas, separation of solids and the gas condensate
c) raw gas conversion
d) washing of the gas with a suitable washing agent, e.g. methanol, for separating hydrogen sulfide, carbon dioxide and moisture, wherein the washing agent is circulated via a regeneration plant
e) catalytically supported conversion of the carbon monoxide and dioxide contained in the gas and of hydrogen to synthetic natural gas, substantially consisting of methane and steam
f) predrying of the gas by condensation of moisture by means of cooling and/or cold water
g) drying of the gas, alternatively by absorption drying by a wash by means of glycol or by molecular sieve adsorption drying.

As solid carbonaceous fuel lignite or hard coal, as liquid fuel heavy oil or tar frequently is used.

A widely used method for gasifying coal for example is the fixed-bed pressure gasification method, cf. Ullmann's Encyclopedia of Industrial Chemistry, 6th Ed., Vol. 15, Gas Production, Chap. 4.4.

The principle of process stage b), cooling of the gas and separation of the gas condensate, is described in the patent specification DE 2 542 055 C3.

Known methods for gasifying heavy oil are described in Ullmann's Encyclopedia of Industrial Chemistry, 6th Ed., Vol. 15, Gas Production, Chap. 3.2.

In the raw gas conversion according to process step c), carbon monoxide is converted into carbon dioxide and hydrogen by adding steam to the gas, catalytically supported, to an extent as it is required for the succeeding process step e), cf. Ullmann's Encyclopedia of Industrial Chemistry, 6th Ed., Vol. 15, Gas Production, Chap. 5.1.2 Raw Gas Shift Catalyst and Ullmanns Encyklopädie der technischen Chemie, 4th Ed., Vol. 14, Kohle, Gaserzeugung, Chap. 5.1.4.

A widely used process according to process step d) is the so-called Rectisol® process, cf. Ullmann's Encyclopedia of Industrial Chemistry, 6th Ed.,Vol. 15, Gas Production, Chap. 5.4.2.1. The methanol used for gas washing is circulated via a regeneration plant. The regeneration plant also comprises a methanol-water separation column.

The catalytically supported conversion of the carbon monoxide and dioxide contained in the gas and of hydrogen to synthetic natural gas according to process step e), which also is referred to as methanation, can be effected with a process which comprises a cascade of e.g. three reactors which each are filled with a fixed bed of a methanation catalyst and which one after the other are traversed by the gas. The carbon monoxide and dioxide contained in the synthesis gas is converted into methane and steam by using hydrogen. The principle of the methanation is described e.g. in Ullmann's Encyclopedia of Industrial Chemistry, 6th Ed., Vol. 15, Gas Production, Chap. 5.3.

In process step f), the steam for the most part is condensed out by cooling the gas to a temperature above 0° C. by means of cooling or cold water.

The residual moisture content is removed from the gas by drying processes according to process step g). The principle of this process, applied to natural gas, is described in Ullmanns Encyklopädie der technischen Chemie, 4th Ed., Vol. 10, Erdgas, Aufbereitung, Chap. 2.2. These processes equally can be applied both for natural and for synthetic natural gas.

In this process it is disadvantageous that in process step g) a regeneration of the glycol laden with moisture or of the molecular sieve is necessary. In addition, there is each obtained a gas stream laden with hydrocarbons, which, since a separation or combustion of the hydrocarbons would be uneconomic, in many cases is disposed of into the environment untreated or is supplied to a possibly present torch system.

DESCRIPTION OF THE INVENTION

It is the object of the invention to provide a process which avoids the disadvantages of the prior art. This object is solved by a process according to the features of claim 1.

According to the invention, the prior art processes for removing the residual moisture by a condensation of the moisture at a low temperature corresponding to the targeted dew point, which are mentioned in process step g), are replaced. After having been predried in process step f) by condensing out the moisture by means of cooling and/or cold water, the gas is mixed with methanol, so that methanol is present in the gas in the form of vapor or aerosol. For this purpose, the methanol preferably is brought in contact with the gas by injection or spraying in. The gas then is passed through a condenser, wherein it is cooled to the desired dew point of below 0° C. The water condensed out along with the methanol distributed in the gas forms a liquid water-methanol solution. The formation of a water ice layer on the heat exchanger surface of the condenser is avoided in this way.

The water-methanol solution is separated from the gas and the gas is heated to the desired discharge temperature, so that dried synthetic natural gas is obtained. In the process according to the invention it is advantageous that with the exception of methanol, which anyway is present due to its use in process step d), no further auxiliary substances foreign to the process, such as glycol or adsorbents, are required. The logistic expenditure for handling and keeping these auxiliary substances in stock therefore can be omitted.

In an advantageous aspect of the invention the water-methanol solution separated from the water is charged for processing into the methanol-water separation column of the regeneration means of process step d). Due to the utilization of the separating apparatus present already, a particularly efficient procedure is obtained.

INDUSTRIAL APPLICABILITY

With the invention, an economic and environmentally friendly process thus is provided for the treatment of raw gas produced by pressure gasification of solid, carbonaceous feedstocks, which provides for a higher energy efficiency with regard to the thermal energy contained in the raw gas and in the gas condensate.

The invention claimed is:

1. A process for producing dry synthetic natural gas from solid or liquid, carbonaceous fuel, said process comprising the following process steps carried out in the following order:

a) preparing a first gas by gasifying the fuel, wherein said first gas consists substantially of carbon monoxide, carbon dioxide, methane and hydrogen;

b) preparing a second gas by cooling said first gas and separating from the first gas solids and a gas condensate;

c) preparing a third gas by converting carbon monoxide in said second gas into carbon dioxide and hydrogen;

d) preparing a fourth gas by separating hydrogen sulfide, carbon dioxide and steam from said third gas by washing the third gas with methanol as solvent, wherein the methanol is circulated via a regenerating means for separating hydrogen sulfide, carbon dioxide and water from the methanol, wherein the regenerating means also comprises a methanol-water separation column;

e) preparing a fifth gas by catalytically-supported-conversion of the carbon monoxide, residual carbon dioxide and hydrogen in the fourth gas, wherein the fifth gas consists substantially of methane and steam;

f) preparing a sixth gas by predrying the fifth gas by condensing moisture by means of cooling and/or cold water;

g) preparing a seventh gas by adding methanol to the sixth gas;

h) preparing an eighth gas by separating steam from the seventh gas and condensing out the steam by forming a water-methanol mixture;

i) preparing a ninth gas by separating the water-methanol mixture from the eighth gas; and j) obtaining said dry synthetic natural gas by heating the ninth gas to a desired discharge temperature.

2. The process according to claim 1, wherein the water-methanol mixture separated in step i) is introduced into the regenerating means of step d) and treated in the methanol-water separation column.

* * * * *